US011739767B1

(12) United States Patent
Martin

(10) Patent No.: US 11,739,767 B1
(45) Date of Patent: Aug. 29, 2023

(54) MOUNTING SYSTEM FOR FAN

(71) Applicant: Seneca Dairy Systems LLC, Seneca Falls, NY (US)

(72) Inventor: Earl M. Martin, Seneca Falls, NY (US)

(73) Assignee: Seneca Dairy Systems LLC, Seneca Falls, NY (US)

( * ) Notice: Subject to any disclaimer, the term of this patent is extended or adjusted under 35 U.S.C. 154(b) by 74 days.

(21) Appl. No.: 17/164,189

(22) Filed: Feb. 1, 2021

(51) Int. Cl.
*F04D 29/60* (2006.01)
*F04D 29/34* (2006.01)
*F04D 29/26* (2006.01)

(52) U.S. Cl.
CPC ..... *F04D 29/601* (2013.01); *F04D 29/263* (2013.01); *F04D 29/34* (2013.01)

(58) Field of Classification Search
None
See application file for complete search history.

(56) References Cited

U.S. PATENT DOCUMENTS 4,258,895 A * 3/1981 Rorie ..... F16M 11/22 248/317
6,336,793 B1 * 1/2002 Litvin ..... F04D 25/08 416/246
6,742,309 B2 * 6/2004 Stewart ..... E04H 1/1277 52/79.5
9,441,641 B1 * 9/2016 Criswell ..... F04D 19/002
2003/0037812 A1 * 2/2003 Stewart ..... E04H 1/1277 135/96
2020/0103129 A1 * 4/2020 Calvanico ..... F04D 25/12

FOREIGN PATENT DOCUMENTS

DE 202017104832 U1 * 10/2017 ..... F04D 19/002

* cited by examiner

*Primary Examiner* — Juan G Flores
(74) *Attorney, Agent, or Firm* — David L. Principe; Phillips Lytle LLP

(57) ABSTRACT

A fan mounting system with a fan assembly configured to mount on a mounting tube. The fan assembly has a mounting plate supporting a rotating hub on one side and supporting a motor having a shaft on the opposite side. The mounting plate has a hook for supporting the mounting plate on the mounting tube during installation.

15 Claims, 4 Drawing Sheets

MOUNTING SYSTEM FOR FAN

TECHNICAL FIELD

The present invention relates generally to the field of fans for use in industrial settings or for use in connection with raising livestock.

BACKGROUND ART

Traditional fans require an adapter clamp between the fan and the mounting tube. These type of fans typically require multiple pieces of hardware and sometimes require additional people to hold the fan in position while installing the fasteners to mount the fan on the mounting tube. Accordingly, there is a need for a design that is easier to manufacture and easier to install.

BRIEF SUMMARY OF THE INVENTION

With parenthetical reference to the corresponding parts, portions or surfaces of the disclosed embodiment, merely for the purposes of illustration and not by way of limitation, the present invention meets the above described need by providing a convenient way to mount a fan assembly (13). The fan assembly (13) is designed to not require any additional adapter plates or hardware. This design allows for a lower cost to the user because they do not need to purchase any extra mounting apparatus. It also reduces installation time because there is no need to do any assembly during the installation.

By consolidating the hub (37) into the mounting plate (19), the design allows for a one piece construction rather than multiple pieces to achieve the same effect. This single mounting plate (19) allows for a face mount motor (43) to mount directly to the mounting plate (19) with no extra brackets.

The present invention also allows for pre-positioning the fan assembly (13) when mounting the fan assembly (13) on the mounting tube (16). After hanging the fan assembly (13), it will generally hang at the angle required allowing the installer to make only several small adjustments to position the fan assembly (13) correctly. Since the fan assembly (13) hangs at generally the correct angle even without the fasteners (67), one person can install the fan assembly (13) rather than needing multiple people to hold the fan assembly (13) while attaching it to the mounting tube (16).

The present invention allows for easier mounting of the fan assembly (13) and allows the installer to hang the fan assembly (13) and then install the fasteners (67) at his convenience without the need to hold the fan assembly (13) in position while installing the fasteners (67).

The design of the hook (46) allows for a wider range of mounting options due to the center recess (47) in the hook (46). This recess (47) permits the fan assembly (13) to mount to multiple tube options including the single forward T mount. The recess (47) also allows the fasteners (67) to provide force to a single section of the hook (46) (as opposed to a solid single hook) which allows for a much tighter grip on the mounting tube (16). This is necessary to keep the fan assembly (13) from rotating around the mounting tube (16). It also allows the fan assembly (13) to be mounted on a vertical pipe without sliding on the mount tube (16).

The mounting plate (19) becomes the central fixture that holds the entire fan together. On traditional fans, the mounting bracket used would typically be one of two methods. (1) The mount bracket is attached to the fan motor and the entire stress of the fan is transferred through the shroud, arms, and motor or (2) the connector tubes become the main frame that the motor and the shroud are connected to.

The mounting plate (19) also allows for a C face motor to be mounted with no extra brackets and hardware required.

Each fan assembly (13) may be tied into a control box that is then tied back to a main controller via a wireless signal. Each fan controller is a basic board and computer which reduces the cost. The master controller performs all the logic and pushes the commands to the fan controller. This allows the user to have only one master controller that pushes the commands to multiple lower cost fan controllers wirelessly.

This design allows a user to purchase a fan and plug it in to the wall and to run as a standalone and negates the need for any additional controller purchase.

The user can mount any number of fans in any configuration and each fan will run itself with no additional controller.

If the user does want to tie the fans into other systems, the user can add a controller that take over the control from each fan and synchronizes them with the other systems which may include lights, curtains, sprinklers, baffles, and other fans.

With this design, the wiring is much less expensive. With the wireless capability, control wires going from fan to fan are not needed. Also, the need to run individual wires from each fan to the controller or relay box is eliminated.

Given the normal method of banking the fans, each bank is tied into the same control loop. This arrangement creates a system that is very complex, and generally once it is installed, it will never be changed. The system of the present invention allows the user to change the bank layout, or the control outputs within banks on a per fan basis with a simple setting change.

In one embodiment of the invention, a fan mounting system (10) comprises a fan assembly (13) with a mounting plate (19) having one or more arms (28) extending therefrom. The mounting plate (19) has a face (22) surrounding a central opening (25). The one or more arms (28) extend to a shroud (31). A plurality of blades (34) are supported by a hub (37). The hub (37) is rotatably mounted on the mounting plate (19). The plurality of blades (34) are surrounded by the shroud (31). The hub (37) is configured to receive a drive shaft (40) through the central opening (25) in the mounting plate (19). A motor (43) is configured to be mounted on the face (22) of the mounting plate (19) and is operatively associated with the drive shaft (40).

At least one hook (46) extends from the mounting plate (19). A mounting tube (16) is configured to receive the hook (46) of the fan assembly (13) such that the mounting plate (19) is supported by engagement of the hook (37) with the mounting tube (16) during assembly of the system and the fan assembly (13) is capable of rotating freely about the mounting tube (16) under the force of gravity while supported by engagement of the at least one hook (46) with the mounting tube (16).

In one aspect of the invention, the mounting tube (16) is an L-shaped member having a substantially vertical portion (58) extending to a substantially horizontal portion (55). In another aspect of the invention, the mounting tube (16) is T-shaped with a first substantially horizontal portion (83) and a second substantially horizontal portion (86) supported by a substantially vertical support member (89) disposed between the first and second horizontal portions (83, 86).

In another aspect of the invention, the at least one hook (46) comprises a pair of hook members disposed in spaced apart relation.

In yet another aspect, the system further comprises a plurality of openings (100) disposed in the mounting plate (19) around the central opening (25). The plurality of openings (100) are configured to receive a face mount motor (43).

In another aspect of the invention, the fan assembly (13) rotates into a downward angle under the force of gravity when the mounting plate (19) is supported on the mounting tube (16) by the at least one hook (46).

In another aspect of the invention, the at least one hook (46) has a vertical portion (52) with an opening (64) for receiving a fastener (67). The fastener (67) is configured to tighten the hook (46) around the mounting tube (16) to prevent the fan assembly (13) from rotating about the mounting tube (16).

In yet another aspect of the invention, the fan assembly (13) has a center of gravity such that the fan assembly (13) rotates into a downward angled position when the fan assembly (13) is supported by gravity by engagement of the at least one hook (46) with the mounting tube (16).

In another aspect of the invention, the at least one hook (46) has a J-shape.

DESCRIPTION OF THE PREFERRED EMBODIMENTS

Figure 2:
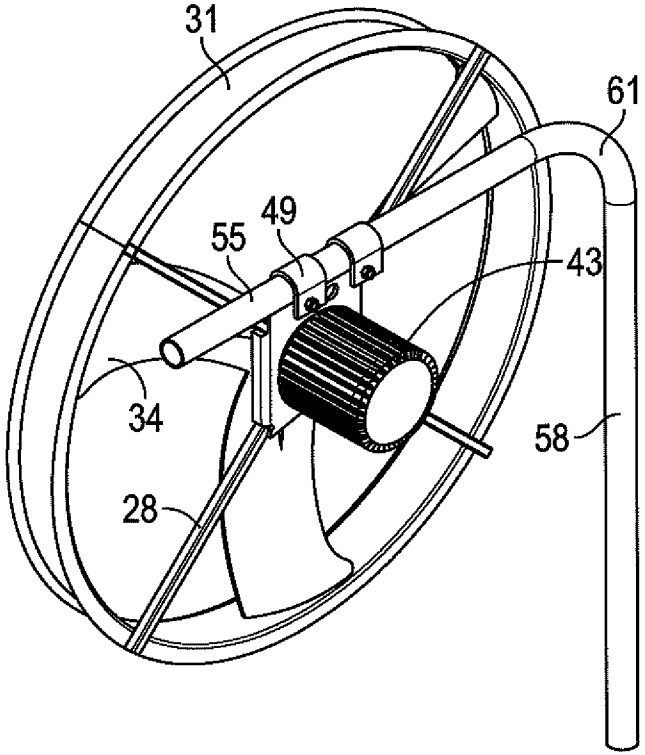
FIG. 2 is a rear perspective view of the fan mounting system shown in FIG. 1.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, debris, etc.) together with the specification, and are to be considered a portion of the entire written description of this invention. As used in the following description, the terms "horizontal", "vertical", "left", "right", "up" and "down", as well as adjectival and adverbial derivatives thereof, (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or of rotation, as appropriate.

Figure 1:
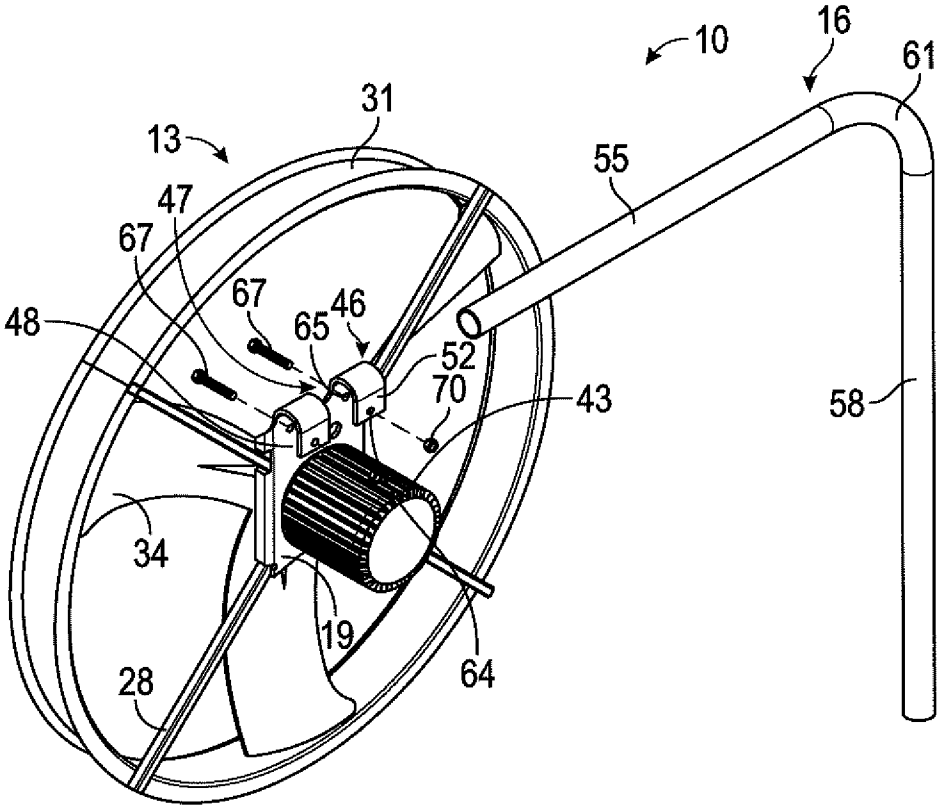
FIG. 1 is a rear exploded perspective view of one embodiment of the fan mounting system of the present invention.
Figure 6:
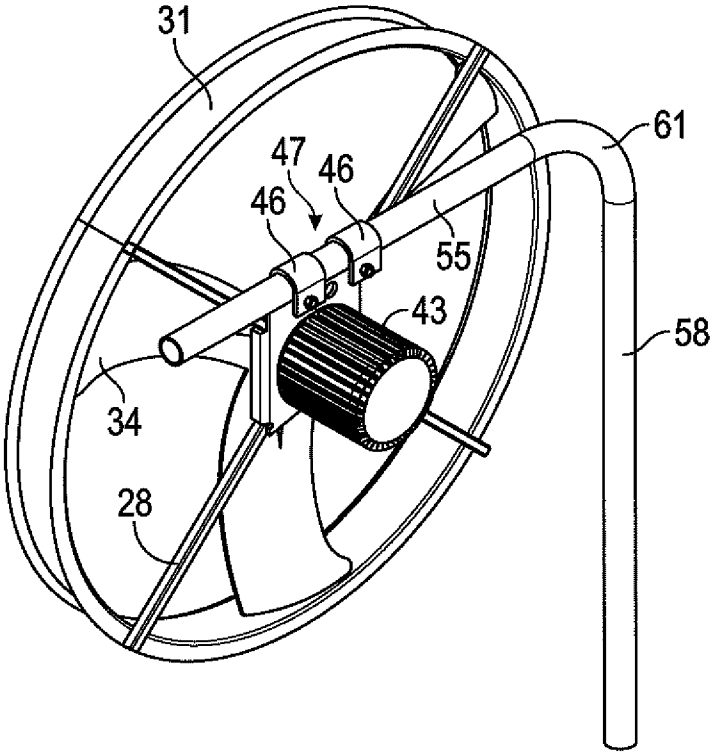
FIG. 6 is a rear perspective view of the fan mounting system of one embodiment of the present invention mounted on an L-shaped mounting tube.
Figure 7:
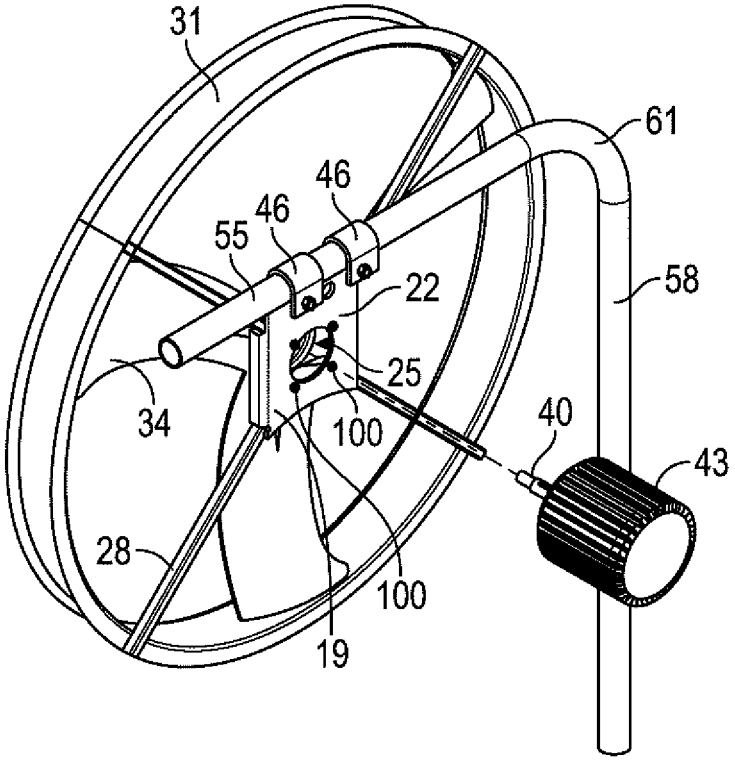
FIG. 7 is a rear exploded perspective view showing the mounting of the motor.

Referring to FIGS. 1-7 generally and initially to FIG. 1, a fan mounting system 10 includes a fan assembly 13 and a mounting tube 16. The fan assembly 13 includes a mounting plate 19 having a face 22 (FIG. 7) surrounding a central opening 25 (FIG. 7). The mounting plate 19 has a plurality of arms 28 extending therefrom. The fan assembly 13 may be constructed of a material such as steel or the like. The plurality of arms 28 extend to a shroud 31. The shroud 31 may be a continuous, circular member having a large circumference. The shroud 31 surrounds a plurality of blades 34. The blades 34 extend from a central hub 37 that may rotate about the center of the mounting plate 19. The hub 37 is supported by and rotates about the mounting plate 19. The hub 37 may be configured to receive a drive shaft 40 (FIG. 7) on a motor 43. The drive shaft 40 extends through the central opening 25 and engages with the hub 37. The motor 43 may be mounted on the face 22 of the mounting plate 19 which is located on the opposite side from the hub 37.

The mounting plate 19 may be provided with one or more hooks 46 that extend from the top of the mounting plate 19. As shown, a pair of hooks 46 have a J-shape with a first portion 48 extending to an arcuate portion 49 that extends to a vertical portion 52. The hooks 46 are disposed in spaced part relation with a recess 47 formed between them. The vertical portion 52 may extend downward in substantially spaced apart parallel relation to the face 22 of the mounting plate 19.

Mounting tube 16 is sized to receive one or more hooks 46 such that the fan assembly 13 can be supported by gravity over the mounting tube 16. Mounting tube 16 has a horizontal portion 55, a vertical portion 58 and a curved portion 61 that connects the two portions. As will be evident to those of ordinary skill in the art based on this disclosure, the vertical and horizontal portions 55, 58 may also be joined at a right angle.

As shown in FIG. 1, the hooks 46 may be provided with openings 64 in the vertical portions 52 of the hooks 46. The openings 64 may align with openings 65 in the mounting plate 19 or in the first portion 48 of the hooks 46. A plurality of fasteners 67 may comprise bolts that extend through the openings 64 and 65 and receive nuts 70. The fasteners 67 provide for securing the fan assembly 13 to the mounting tube 16.

Turning to FIG. 2, the fan assembly 13 is mounted on the mounting tube 16 and the motor 43 is mounted to the face 22 of the mounting plate.

Figure 3:
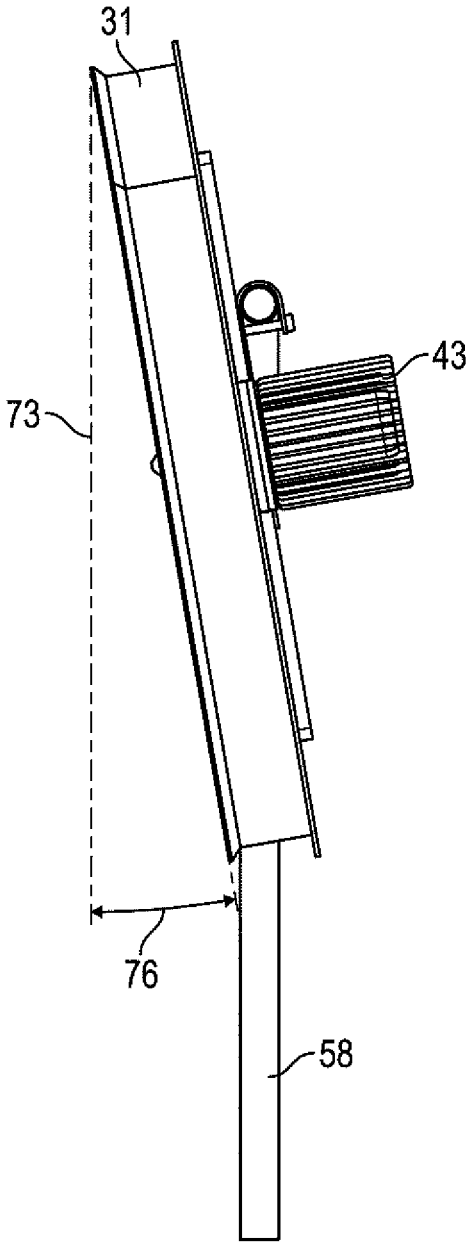
FIG. 3 is a side elevational view of the fan mounting system supported on a mounting tube.

In FIG. 3, the fan assembly 13 is installed on the mounting tube 16 and the shroud 31 and blades 34 are angled with respect to a vertical axis 73. The shroud 31 and blades 34 are disposed at a downward angle caused by rotating the shroud 31 and blades 34 at an angle 76 with respect to the vertical axis 73. The fan assembly 13 rotates about a horizontal axis defined by the mounting tube 16. When the fan assembly 13 is mounted on the mounting tube 16, the assembly 13 has more weight to the left of the horizontal axis defined by the horizontal portion 55. Accordingly, the fan assembly 13 rotates under the force of gravity until it reaches the position shown in FIG. 3. The fan assembly 13 reaches the equilibrium position shown in FIG. 3 and hangs from the mounting tube 16 under the force of its weight without requiring any use of fasteners 67.

Figure 4:
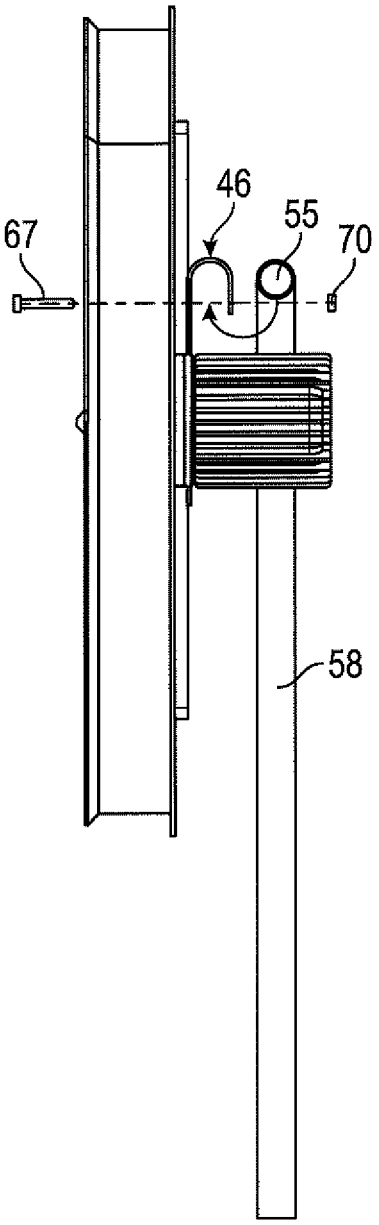
FIG. 4 is a side elevational view of the fan mounting system of FIG. 3 during installation.

As shown in FIG. 4, the fan assembly 13 engages with the mounting tube 16 by placing the at least one hook 46 over the mounting tube 16. The J-shaped hook 46 has an opening 50 defined therein and sized to receive the mounting tube 16. The fastener 67 passes through openings in the first portion 48 of the hook or the mounting plate and through an opening in the vertical portion 52 of the hook 46.

Figure 5:
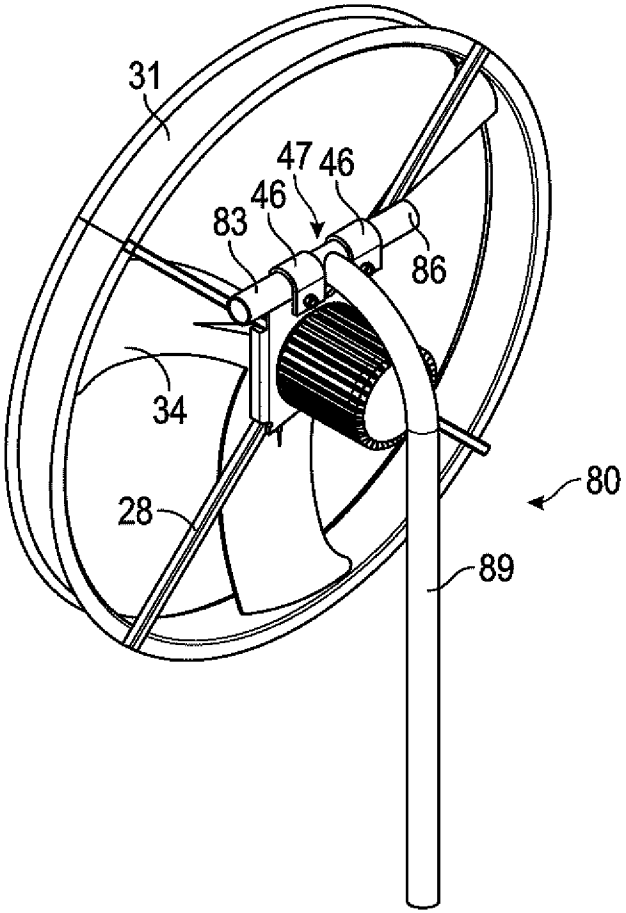
FIG. 5 is a rear perspective view of the fan mounting system of one embodiment of the present invention mounted on a T-shaped mounting tube.

Turning to FIG. 5, in an alternate embodiment mounting tube 80 has a first substantially horizontal portion 83 and a second substantially horizontal portion 86. First and second substantially horizontal portions 83, 86 are supported by a substantially vertical support member 89. The recess 47 between the two hook members 46 provides for attachment of the fan assembly 13 to the mounting tube 80 on opposite sides of the vertical support member 89. Accordingly, the recess 47 provides for mounting the fan assembly 13 on a horizontal mounting tube 16 or a vertical mounting tube 80.

In FIG. 6, arms 28 are shown extending radially from the mounting plate 19 to the shroud 31. In the example shown there are four arms 28 that extend to the shroud 31 from the four corners of the mounting plate 19. As shown the arms 28 overlap the back surface of the shroud 31. The arms 28 may be attached to the shroud 31 by fasteners, welding, gluing or the like. As an alternative, the arms may be integrally formed with the mounting plate 19 and shroud 31.

Turning to FIG. 7, the central opening 25 may be surrounded by a plurality of smaller openings 100 configured to receive a face mount motor 43. The shaft 40 extends through the opening 25 and engages with the hub 37 such that rotation of the shaft 40 causes the blades 34 to rotate. The hub 37 is attached to or integrally formed with the mounting plate 19 and is disposed on the side of the mounting plate 19 opposite from the motor 43.

The present invention provides many advantages. The present invention allows for easier mounting of the fan assembly 13 and allows the installer to hang the fan assembly 13 and then install the fasteners 67 at his convenience without the need to hold the fan assembly 13 in position while installing the fasteners 67.

The design of the hook 46 allows for a wider range of mounting options due to the center recess 47 in the hook 46. This recess 47 permits the fan assembly 13 to mount to multiple tube options including the single forward T mount. The recess 47 also allows the fasteners 67 to provide force to a single section of the hook 46 (as opposed to a solid single hook) which allows for a much tighter grip on the mounting tube 16. This is necessary to keep the fan assembly 13 from rotating around the mounting tube 16. It also allows the fan assembly 13 to be mounted on a vertical pipe without sliding on the mount tube 16.

The mounting plate 19 becomes the central fixture that holds the entire fan together.

The present invention contemplates that many changes and modifications may be made. Therefore, while the presently-preferred form of the mounting system for a fan has been shown and described, and several modifications and alternatives discussed, persons skilled in this art will readily appreciate that various additional changes and modifications may be made without departing from the spirit of the invention, as defined and differentiated by the following claims.

The invention claimed is:

1. A fan mounting system, the system comprising:

a fan assembly with a mounting plate having one or more arms extending therefrom, the mounting plate having a face surrounding a central opening;

the one or more arms extending to a shroud;

a plurality of blades supported by a hub, the hub rotatably mounted on the mounting plate, the plurality of blades surrounded by the shroud, the hub configured to receive a drive shaft through the central opening in the mounting plate;

a motor configured to be mounted on the face of the mounting plate and operatively associated with the drive shaft;

at least one hook extending from the mounting plate; and, a mounting tube configured to receive the at least one hook of the fan assembly such that the mounting plate is supported by engagement of the at least one hook with the mounting tube during assembly of the system and the fan assembly is capable of rotating freely about the mounting tube under the force of gravity while supported by engagement of the at least one hook with the mounting tube.

2. The fan mounting system of claim 1, wherein the mounting tube is an L-shaped member having a substantially vertical portion extending to a substantially horizontal portion.

3. The fan mounting system of claim 1, wherein the mounting tube is T-shaped with a first substantially horizontal portion and a second substantially horizontal portion supported by a substantially vertical support member disposed between the first and second substantially horizontal portions.

4. The fan mounting system of claim 1, wherein the at least one hook comprises a pair of hook members disposed in spaced apart relation.

5. The fan mounting system of claim 1, further comprising a plurality of openings disposed in the mounting plate around the central opening, the plurality of openings configured to receive the motor.

6. The fan mounting system of claim 1, wherein the fan assembly rotates into a downward angle under the force of gravity when the mounting plate is supported on the mounting tube by the at least one hook.

7. The fan mounting system of claim 1, wherein the at least one hook has a distal portion with an opening for receiving a fastener, the fastener configured to tighten the at least one hook around the mounting member to prevent the fan assembly from rotating about the mounting tube.

8. The fan mounting system of claim 1, wherein the fan assembly has a center of gravity such that the fan assembly rotates into a downward angled position when the fan assembly is supported by gravity by engagement of the at least one hook with the mounting tube.

9. The fan mounting system of claim 1, wherein the at least one hook has a J-shape.

10. A fan mounting system, the system comprising:

a fan assembly with a mounting plate having one or more arms extending therefrom, the mounting plate having a face surrounding a central opening;

the one or more arms extending to a shroud;

a plurality of blades supported by a hub, the hub rotatably mounted on the mounting plate, the plurality of blades surrounded by the shroud, the hub configured to receive a drive shaft through the central opening in the mounting plate;

a motor configured to be mounted on the face of the mounting plate and operatively associated with the drive shaft;

a pair of spaced apart hooks extending from the mounting plate;

a mounting tube configured to receive the pair of spaced apart hooks of the fan assembly such that the mounting plate is supported by engagement of the pair of spaced apart hooks with the mounting tube during assembly of the system and the fan assembly is capable of rotating freely about the mounting tube under the force of gravity while supported by engagement of the pair of spaced apart hooks with the mounting tube; and, wherein the fan assembly has a center of gravity such that the fan assembly rotates into a downward angled position when the fan assembly is supported by gravity by engagement of the pair of spaced apart hooks with the mounting tube.

11. The fan mounting system of claim 10, wherein the mounting tube is an L-shaped member having a substantially vertical portion extending to a substantially horizontal portion.

12. The fan mounting system of claim 10, wherein the mounting tube is T-shaped with a first substantially horizontal portion and a second substantially horizontal portion supported by a substantially vertical support member disposed between the first and second substantially horizontal portions.

13. The fan mounting system of claim 10, further comprising a plurality of openings disposed in the mounting plate around the central opening, the plurality of openings configured to receive the motor.

14. The fan mounting system of claim 10, wherein the pair of spaced apart hooks has a distal portion with an opening for receiving a fastener, the fastener configured to tighten the pair of spaced apart hooks around the mounting tube to prevent the fan assembly from rotating about the mounting tube.

15. The fan mounting system of claim 10, wherein the pair of spaced apart hooks have a J-shape.

* * * * *